US008430164B2

(12) United States Patent
Audibert-Hayet

(10) Patent No.: US 8,430,164 B2
(45) Date of Patent: Apr. 30, 2013

(54) PRODUCTION OF STEAM AND ITS APPLICATION TO ENHANCED OIL RECOVERY

(75) Inventor: Annie Audibert-Hayet, Croissy (FR)

(73) Assignee: Total S.A., Croissy (FR)

( * ) Notice: Subject to any disclaimer, the term of this patent is extended or adjusted under 35 U.S.C. 154(b) by 385 days.

(21) Appl. No.: 12/829,434

(22) Filed: Jul. 2, 2010

(65) Prior Publication Data

US 2011/0005751 A1 Jan. 13, 2011

(51) Int. Cl.
*E21B 43/24* (2006.01)
*E21B 43/34* (2006.01)

(52) U.S. Cl.
USPC ..... 166/267; 166/52; 166/57; 166/272.3; 166/303; 210/202; 210/638; 210/639; 210/665; 210/722

(58) Field of Classification Search ..... None
See application file for complete search history.

(56) References Cited

U.S. PATENT DOCUMENTS 3,654,103 A * 4/1972 McRae ..... 423/235
5,611,931 A * 3/1997 Liu et al. ..... 210/653
5,957,202 A * 9/1999 Huang ..... 166/272.3
7,820,057 B2 * 10/2010 Verdoes et al. ..... 210/714
7,858,058 B2 * 12/2010 Bargeman et al. ..... 423/184
2009/0056940 A1 * 3/2009 Minnich et al. ..... 166/266
2009/0056945 A1 * 3/2009 Minnich et al. ..... 166/272.3
2010/0200231 A1 * 8/2010 Minnich ..... 166/272.3
2010/0294719 A1 * 11/2010 Polizzotti et al. ..... 210/654

* cited by examiner

*Primary Examiner* — George Suchfield
(74) *Attorney, Agent, or Firm* — IP Attorneys Group, LLC

(57) ABSTRACT

The invention relates to a method for producing steam comprising the successive steps of:

providing feedwater containing carbonate and/or sulfate ions;

adding a crystallizing reagent able to react with carbonate and/or sulfate ions to the feedwater, in order to produce carbonate and/or sulfate crystals;

filtering the feedwater with a ceramic membrane to produce a permeate stream;

supplying the permeate stream to a boiler; and generating steam in the boiler.

The invention also relates to an installation adapted for implementing said method, as well as to a process for extracting hydrocarbons from a subterranean formation using the abovementioned method for producing steam.

21 Claims, 1 Drawing Sheet

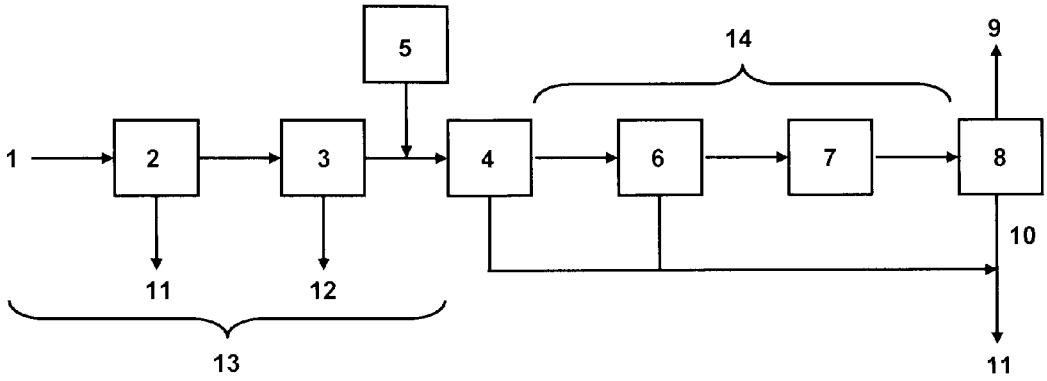
5
14
9
1
2
3
4
6
7
8
10
11
12
13
11

PRODUCTION OF STEAM AND ITS APPLICATION TO ENHANCED OIL RECOVERY

TECHNICAL FIELD

The present invention relates to a method for producing steam and to an installation adapted for implementing said method. The invention also relates to a method for extracting hydrocarbons from a subterranean formation using the steam thus produced.

TECHNICAL BACKGROUND

Producing the world's enormous reserves of immobile heavy oil or mobile oil with high viscosity located beyond the reach of open pit mining techniques requires the use of thermal processes. These processes deliver heat to the reservoir in one way or another to heat the oil and mobilize it for production. The dominant thermal processes are:

Steam Assisted Gravity Drainage;

Steam Drive; and

Cyclic Steam Stimulation.

Steam Assisted Gravity Drainage (SAGD) is a thermal recovery technique widely used for the recovery of extra heavy oils, in which pairs of horizontal injector and producer wells are drilled within the drains roughly 5 m apart. Steam is injected to heat and mobilize the oil, so that it will flow into the producer by gravity drainage assisted by a growing steam chamber. It is the most common thermal recovery technique for extra heavy oil found in oil sands reservoirs.

Steam Drive is another process where steam is continuously injected into dedicated wells (vertical, deviated or horizontal, placed around, or next to, the producers in a predetermined pattern).

Cyclic Steam Stimulation is a single well process, where steam is injected for a certain period of time, then allowed to soak into and heat the oil. Finally, the heated oil and condensed water/steam are produced back through the same well for a period of time.

For all these processes, water is used to generate steam, and the typical water consumption associated with steam generation may be in the order of 3 volumes of water for one volume of produced bitumen, e.g. producing 100,000 b/day of bitumen using a thermal process may require 300,000 b/day (50,000 $m^3$/day) of water. Thermal production may involve consumption of fresh water, but great efforts are made to maximize water recycling: in steam projects, 85% to 95% of the produced water returning from producer wells is recycled via treatment processes.

Steam generation equipment can take various forms that generally include either once through steam generators (OTSG) or conventional boilers. Water of suitable quality is required for feeding the boilers and steam generators.

One of the problems involved in the generation of steam is indeed the presence of mineral contaminants in the water, mainly carbonates, sulfates and silica. As water is heated and converted into steam, the mineral contaminants tend to be left in the steam generator or boiler. Indeed, the steam generator or boiler functions as a distillation unit, taking pure water out as steam and leaving behind concentrated minerals. Scale forms as a result of the precipitation of normally soluble solids that become insoluble in the steam generator or boiler. Scale acts as an insulator, reducing boiler efficiency. Scaling can lead to boiler tube failure due to overheating. For carbonate and bicarbonate species, such phenomena may be detrimental to the application since they may decompose at high temperature producing acidic steam in equilibrium with alkaline water.

The water treatment usually involves heavy processes for de-oiling, silica removal and hardness treatment (hard water is a type of water that has high mineral content with calcium, magnesium metal cations and sometimes other dissolved compounds such as bicarbonates and sulfates). The complexity of the water treatment scheme required depends on the development scheme (whether or not there is a recycling of the produced water to feed the boiler), the feed-water specifications, and the type of boiler.

De-oiling conventionally involves a skim tank, gas flotation and filtration. The de-oiling stage is an essential stage when a recycling scheme is implemented (i.e. when the produced water is used as feed-water in the boiler).

After the de-oiling stage, water should be treated against hardness and silica deposition. This complementary water treatment depends on the type of boiler. Indeed, the boilers are usually classified into two main categories:

- 80% Quality Steam boilers (OTSG boilers) which produce 20% of water blowdown to be treated; this type of boiler can handle low quality feed water charged in silica, dissolved solids and salts. The associated water treatment is based on lime softening and acid cation exchange.
- 100% Quality Steam Boilers (conventional drum or Pulverized Coal boiler or Circulating Fluidized Bed boilers) which produce only traces of blowdown. This type of boiler requires more stringent water specifications. The associated water treatment may be based on evaporator technology. It helps to achieve a much higher quality feed water for the boiler than with the lime softening +ion exchange process. The principle of the evaporator is to boil the produced water to generate a stream of vapor (less charged in silica and minerals) and a stream of produced water charged in silica and minerals (which are not evaporated). This non-evaporated produced water is recirculated until it starts to produce waste brine (which is removed).

Mineral contaminant removal must at any rate be adapted to the type of water used and to the conditions of operation. In particular, when water is recycled, the treatment of silica is often the most prominent concern because silica tends to accumulate in the water cycle especially if the hydrocarbon formation has a high silica content (silica is dissolved in the reservoir by steam injection).

Conversely, there are other instances where silica is not the primary concern (for example because the produced water is not recycled to boiler feedwater and/or because the primary source of feedwater is poor in silica) but where carbonate and/or sulfate ions are a major issue (for example because the primary source of feedwater is rich in carbonate and/or sulfate ions).

In such instances, carbonate and/or sulfate ion removal is conventionally primarily performed by adding one or more chemical substances to the feedwater in order to precipitate the carbonate and/or sulfate ions, and by decanting the precipitated material. However, large quantities of chemical substances are generally required; besides, the decantation time is high and the corresponding settling tanks are very large.

Another option, specifically for carbonate ion removal, consists in acidifying the water so as to convert the carbonate ions to carbon dioxide, and agitating the water so as to degas it, thus eliminating the carbon dioxide. However this option is not feasible in view of the large water tank volumes which would be required for its implementation.

Document WO 2009/029651 teaches to use a ceramic membrane for removing silica from feedwater. Document WO 2009/029653 teaches to eliminate silica by adsorption on mineral species at a high pH, so as to also remove it from feedwater. However, in both cases the process is ineffective for removing large quantities of carbonate or sulfate ions.

There is thus a need for an improved process for removing carbonate and/or sulfate ions from boiler feedwater. In particular, there is a need for a quicker process, using smaller settling tanks and/or less chemical substances.

SUMMARY OF THE INVENTION

It is a first object of the invention to provide a method for producing steam comprising the successive steps of:

- providing feedwater containing carbonate and/or sulfate ions;
- adding a crystallizing reagent able to react with carbonate and/or sulfate ions to the feedwater, in order to produce carbonate and/or sulfate crystals;
- filtering the feedwater with a ceramic membrane to produce a permeate stream;
- supplying the permeate stream to a boiler; and
- generating steam in the boiler.

According to one embodiment, the method comprises, prior to supplying the permeate stream to the boiler, the additional step of:

- treating the permeate stream in an ion exchange unit; and/or
- treating the permeate stream in a reverse osmosis unit; and/or treating the permeate stream in an evaporation unit.

According to one embodiment, the crystallizing reagent is a salt selected from the group consisting of chloride, bromide, fluoride and nitrate salts of calcium, barium, strontium, manganese or magnesium, or mixtures thereof.

According to one embodiment, the feedwater contains between 50 and 10000 mg/L carbonate ions, preferably between 100 and 5000 mg/L carbonate ions; and/or wherein the feedwater contains between 10 and 2000 mg/L sulfate ions, preferably between 100 and 1000 mg/L sulfate ions.

According to one embodiment, the crystallizing reagent is a salt having an anion and a cation, and is dosed to a molar ratio of crystallizing reagent cation-to-carbonate and sulfate ions in the feedwater of between 0.5:1 and 3:1, preferably of about 1:1.

According to one embodiment, the method of the invention does not comprise any pH adjustment step prior to the step of filtering the feedwater.

According to one embodiment, the method of the invention does not comprise any step of substantially removing silica from the feedwater or from the permeate stream.

According to an alternative embodiment, the method further comprises a step of substantially removing silica from the permeate stream by:

- treating the permeate stream from the ceramic membrane in a warm lime softening unit; or
- adding an additional crystallizing reagent able to react with silica to the permeate stream from the ceramic membrane and optionally adjusting the pH of said permeate stream, in order to convert soluble silica to insoluble silica, and then filtering the permeate stream in an additional ceramic membrane to produce the permeate stream to be supplied to the boiler.

According to one embodiment, the provided feedwater is produced water from an oil production process, wherein the oil production process does not involve any steam injection.

According to one embodiment, the method does not comprise any induced gas flotation step prior to adding the crystallizing reagent to the feedwater.

According to one embodiment, the boiler generates a liquid blowdown and wherein the liquid blowdown is either evacuated in the environment or at least partly recycled to the feedwater.

It is a further object of the invention to provide an installation for producing steam comprising:

- a ceramic membrane;
- a boiler;
- a steam conduit connected to an outlet of the boiler;
- a feedwater supply system connected to an inlet of the ceramic membrane;
- means for supplying a crystallizing reagent able to react with carbonate and/or sulfate ions to produce carbonate and/or sulfate crystals, an outlet of which is connected to the feedwater supply system; and
- a permeate stream conduit connected to an outlet of the ceramic membrane and connected to an inlet of the boiler.

According to one embodiment, the installation comprises a further treatment unit on the permeate stream conduit, said further treatment unit preferably comprising:

- an ion exchange unit; and/or
- a reverse osmosis unit; and/or
- an evaporation unit.

According to one embodiment, the further treatment unit comprises a silica removal unit, such as:

- a warm lime softening unit; and/or
- an additional ceramic membrane, means for supplying an additional crystallizing reagent able to react with silica to convert soluble silica to insoluble silica, and optionally means of pH adjustment, upstream of the additional ceramic membrane.

According to an alternative embodiment, the installation of the invention does not comprise any silica removal unit.

According to one embodiment, the feedwater supply system is connected to an outlet of a water recovery system from an oil production installation, wherein said oil production installation does not comprise any steam generation unit.

According to one embodiment, the installation of the invention does not comprise any induced gas flotation unit.

According to one embodiment, the installation of the invention comprises a liquid blowdown conduit connected to an outlet of the boiler, an outlet of said liquid blowdown conduit being optionally connected to the feedwater supply system.

According to one embodiment, the steam conduit is connected to an inlet of an injection well.

It is yet a further object of the invention to provide a process for extracting hydrocarbons from a subterranean formation comprising:

- producing steam according to the abovementioned method;
- injecting the produced steam into at least one injection well; and
- recovering hydrocarbons and produced water from at least one collection well.

The present invention enables to overcome the drawbacks of the prior art. In particular the invention provides an improved process for removing carbonate and/or sulfate ions from boiler feedwater, namely a quicker process, wherein it is possible to use small sized-equipment and/or less chemical substances.

This is achieved by using a crystallizing reagent which is able to react with carbonate and/or sulfate ions in order to produce carbonate and/or sulfate micro crystals and a ceramic membrane for filtering the water and eliminating the carbonate and/or sulfate crystals.

As the ceramic membrane can retain and eliminate crystals having a small size, it is not necessary to perform an extensive crystallization, since a moderate crystallization will be sufficient for effectively removing the carbonates and/or sulfates. Accordingly, it is possible to add the crystallizing reagent in a moderate amount and/or to avoid using large equipment and/or to remove carbonate and/or sulfate ions in a quick and efficient manner.

BRIEF DESCRIPTION OF THE DRAWINGS

FIG. 1 schematically shows an installation for producing steam according to the invention.

DESCRIPTION OF EMBODIMENTS

The invention will now be described in more detail without limitation in the following description.

Generation of Steam

In the present invention, and with reference to FIG. 1, steam is produced in a boiler 8, an outlet of which is connected to a steam conduit 9. The boiler 8 can be a conventional boiler or a once through steam generator (OTSG). An OTSG has a lower yield than a conventional boiler, as a result of which a liquid blowdown is produced if the boiler 8 is an OTSG. In that case, a liquid blowdown conduit 10 is provided at an outlet of the boiler 8. The liquid blowdown may be evacuated in the environment, or suspended solids may be recovered first and sent to landfill 11.

The boiler 8 is supplied with water which is previously treated so as to remove a substantial portion of the carbonate and/or sulfate ions present in said water.

Accordingly, a feedwater supply system 13 is provided, for supplying water. This feedwater supply system 13 comprises a source of water 1. The water from the source of water 1 contains sulfate and/or carbonate ions.

In the present application, the term <<carbonate ions>> is to be understood in a generic way as meaning either $CO_3^{2-}$ carbonate ions or $HCO_3^-$ bicarbonate ions.

For example the water from the source of water 1 may contain between 50 and 10000, preferably between 100 and 5000 mg/L carbonate ions; and between 10 and 2000, preferably between 100 and 1000 mg/L sulfate ions.

It may also contain silica, preferably in the amount of between 0 and 500 mg/L, preferably between 15 and 400 mg/L.

The water from the source of water 1 is optionally fed to a skimming unit 2. In the skimming unit 2, suspended materials such as solids and oil droplets are removed from the water. An oil recovery line 11 may thus be provided at an outlet of the skimming unit 2. Said oil recovery line 11 is advantageously directed to a hydrocarbon collection and treatment system (not shown).

The feedwater exiting from the skimming unit 2 is optionally fed to an induced gas flotation unit 3 in order to further remove suspended materials (primarily oil droplets and possibly some solids) from the water. In the induced gas flotation unit 3, gas is stripped through the water. The gas bubbles adhere to the suspended matter causing it to float to the surface of the water where it may then be removed by a skimming device. A further oil recovery line 12 may thus be provided at an outlet of the induced gas flotation unit 3. Said further oil recovery line 12 is advantageously directed to a hydrocarbon collection and treatment system (not shown).

Thereafter, a crystallizing reagent is added to the feedwater, using means for supplying the crystallizing reagent 5. Said means for supplying the crystallizing reagent 5 typically include a storage unit for the crystallizing reagent, as well as means for dosing the crystallizing reagent and injecting it into the water. The crystallizing reagent may be stored and injected in a dry (powder) form or in a liquid form, i.e. as a concentrated solution or suspension. A mixing device may be provided for mixing the crystallizing reagent with the feedwater, but such a mixing device is generally not necessary.

The crystallizing agent is selected according to its ability to react with carbonate and/or sulfate ions to produce carbonate and/or sulfate crystals. Examples of possible crystallizing agents include calcium chloride, barium chloride, strontium chloride, manganese chloride, magnesium chloride and mixtures thereof. Other salts may be used from the same cations but associated with bromide, fluoride, nitrate etc.

Calcium chloride, barium chloride, magnesium chloride and strontium chloride are efficient for crystallizing both sulfate and carbonate ions. On the other hand, manganese chloride is efficient only for crystallizing carbonate ions but not sulfate ions.

Typically, the crystallizing reagent is added to the feedwater at a concentration to induce crystallization. A few examples of co-precipitation of sulfate and carbonate salts can be found in the literature for example in T. H. Chong et al, *Chemical Engineering Science,* 56, 5391 (2001).

Preferably, the molar ratio of crystallizing reagent cation-to-carbonate and sulfate ions is between 0.5:1 and 3:1, and more preferably is about 1:1.

Once the crystallizing reagent is added in the feedwater, carbonate and/or sulfate crystals start forming in the feedwater within the feedwater supply system. The formation of crystals may occur in a broad range of pH, generally above 7, so that a preliminary pH adjustment step is generally unnecessary. In a general way, the relevant conditions are selected according to solubility diagrams, which can be found e.g. in W. Stumm et al *Aquatic Chemistry*, Wiley ed. (1996).

The feedwater is then fed to a ceramic membrane 4, which retains part or all of the carbonate and/or sulfate crystals formed. A permeate stream (feedwater depleted in sulfate and/or carbonate ions) is produced at an outlet of the ceramic membrane 4 and is recovered via a permeate stream conduit 14, which in turn feeds the boiler 8.

Ceramic membranes which can be used for implementing the present invention are known in the art. One may refer in particular to documents U.S. Pat. No. 6,165,553 and U.S. Pat. No. 5,611,931, the contents of which are expressly incorporated herein by reference. These ceramic membranes, useful in the present invention, can be of various types.

In some cases the ceramic membrane may be of the type that produces both a permeate stream and a reject stream. On the other hand, the ceramic membranes may be of the dead head type, which only produces a permeate stream and from time-to-time the retentate is backflushed or otherwise removed from the membrane.

The structure and materials of the ceramic membranes as well as the flow characteristics of ceramic membranes vary. In case the feedwater comprises produced water, the ceramic membranes are designed to withstand relatively high temperatures as it is not uncommon for the produced water being filtered by the ceramic membranes to have a temperature of approximately 90° C. or higher.

Ceramic membranes normally have an asymmetrical structure composed of at least two, mostly three, different porosity levels. For example the membrane may comprise an active, microporous top layer, an intermediate layer and a microfiltration separation layer. The macroporous support ensures the mechanical resistance of the filter.

Ceramic membranes are often formed into an asymmetric, multi-channel element. These elements are grouped together in housings, and these membrane modules can withstand high temperatures, extreme acidity or alkalinity and high operating pressures, making them suitable for many applications where polymeric and other inorganic membranes cannot be used. Several membrane pore sizes are available to suit specific filtration needs covering the microfiltration, the ultrafiltration, and nanofiltration, with ranges from a pore size of 1 micron down to 250 Dalton MWCO.

Ceramic membranes run the gamut of materials, from alpha alumina to zircon. The most common membranes are made of Al, Si, Ti or Zr oxides, with Ti and Zr oxides being more stable than Al or Si oxides. In some less frequent cases, Sn or Hf are used as base elements. Each oxide has a different surface charge in solution. Other membranes can be composed of mixed oxides of two of the previous elements, or are established by some additional compounds present in minor concentration. Low fouling polymeric coatings for ceramic membranes are also available.

Ceramic membranes are typically operated in the cross flow filtration mode. This mode has the benefit of maintaining a high filtration rate for membrane filters compared with the direct flow filtration mode of conventional filters. Cross flow filtration is a continuous process in which the feed stream flows parallel (tangential) to the membrane filtration surface and generates two outgoing streams.

A small fraction of feed called permeate or filtrate, separates out as purified liquid passing through the membrane. The remaining fraction of feed, called retentate or concentrate, contains particles rejected by the membrane.

The separation is driven by the pressure difference across the membrane, or the trans-membrane pressure. The parallel flow of the feed stream, combined with the boundary layer turbulence created by the cross flow velocity, continually sweeps away particles and other material that would otherwise build up on the membrane surface.

The ceramic membrane produces a reject stream having the insoluble crystals therein. A portion of the ceramic membrane's reject stream can be recirculated to the ceramic membrane. Typically, about 1-10% of the water in the feed stream passes through the ceramic membrane as permeate. A relatively high recirculation rate maintains a relatively high cross flow velocity across the ceramic membrane, which inhibits fouling. Recirculation of the reject stream is continued until the concentration of the suspended solids in the reject stream reaches approximately 1% to 3% by weight. Once this level of solids concentration in the reject stream is reached, then a selected flow of the reject stream can be bled off and directed to a dewatering process for example. Water from the dewatering process can be directed back and mixed with the feedwater for continued treatment.

Alternatively, in the case of a direct flow filtration mode of operation, the carbonate and/or sulfate crystals retained on the ceramic membrane 4 can be periodically recovered as a retentate stream using a backflow, optionally loaded with appropriate chemical substances.

In any case, the suspended solids (notably carbonate and/or sulfate crystals) from the retentate or reject stream are sent to landfill 11.

The permeate stream, in the permeate stream conduit 14, is sent to the boiler 8.

It should be noted that the ceramic membrane is preferably also suitable for retaining possible remaining traces of hydrocarbons in the water. In this case, it is advantageously possible to do without the induced gas flotation unit 3, which results in notable savings.

It should also be noted that the association of the crystallizing reagent and of the ceramic membrane described above is not suitable for substantially removing silica from the water. Only carbonate and sulfate ions are substantially removed at this stage.

Preferably, the concentration of carbonate ions is below 200 mg/L, more preferably below 50 mg/L in the permeate stream.

Preferably, the concentration of sulfate ions is below 10 mg/L, more preferably below 2 mg/L in the permeate stream.

A permeate stream storage unit 7 may be included on the permeate stream conduit 14 if needed. Means for treating the permeate stream may optionally be provided in the permeate storage unit 7, such as means for removing oxygen, in order to avoid corroding the boiler 8. Such means for removing oxygen may comprise gas stripping or the addition of sulfite or bisulfite to the water.

In addition, a further treatment unit 6 may also be included on the permeate stream conduit 14, advantageously upstream of the permeate stream storage unit 7. In the further treatment unit 6, a finishing treatment for removing carbonate and/or sulfate ions may be performed, and/or another complementary treatment, e.g. for removing other contaminants (notably silica) may be performed.

Accordingly, when a finishing treatment for removing carbonate and/or sulfate ions is needed, the further treatment unit 6 may comprise:

an ion exchange unit; and/or
a reverse osmosis unit; and/or
an evaporation unit.

When a treatment for removing silica is needed, the further treatment unit 6 may comprise a silica removal unit, and in particular:

a warm lime softening unit; and/or
an additional ceramic membrane and means for supplying an additional crystallizing reagent able to react with silica to convert soluble silica to insoluble silica, upstream of the additional ceramic membrane.

The latter case corresponds to the method of removing silica from water which is disclosed in WO 2009/029651, the content of which is hereby incorporated by reference.

The additional crystallizing reagent is any reagent suitable for converting soluble silica to insoluble silica. Preferred additional crystallizing reagents include magnesium oxide or magnesium chloride. These magnesium-based reagents form magnesium hydroxide crystals, to which the silica is adsorbed, which results in the conversion of silica from soluble to insoluble form. Other suitable additional crystallizing reagents include ferric chloride, aluminum oxide, aluminum sulfate, calcium oxide or alum, as well as surface active materials (such as oxides of aluminum, silica and titanium). Mixtures of the above reagents may also be used.

The water supplemented with the additional crystallizing reagent is fed to the additional ceramic membrane, which is and functions as described above in relation with the main ceramic membrane.

The pH of the water must be maintained in the range of 9.5 to 11.2 and preferably of 10.0 to 10.8, in order for the conversion of soluble silica to insoluble silica to take place. Therefore, addition of a pH adjusting agent (such as sodium hydroxide) may be necessary prior to supplying the additional ceramic membrane with the water/additional crystallizing reagent mixture.

Alternatively, it is possible to do without any treatment for removing silica, if the silica content of the water from the source of water 1 is sufficiently low (and especially if the source of water 1 does not comprise any produced water from a SAGD-operated collection well).

The suspended solids recovered from the further treatment unit 6 may be sent to landfill 11.

As already mentioned above, the liquid blowdown from the boiler 8, when present, may be rejected. Alternatively, it is also possible to recycle all or part of the liquid blowdown to the feedwater supply system 13. Thus, the need of a dedicated rejection site is avoided; besides, in principle the liquid blowdown contains less mineral contaminants (and notably less carbonate and/or sulfate ions) than the water from the source of water 1. Consequently, recycling the liquid blowdown provides a dilution of the feedwater and alleviates the requirements of the downstream units.

Hydrocarbon Extraction

The method and installation described above for generating steam are advantageously used in a method, respectively in an installation, for extracting hydrocarbons from a subterranean formation.

In this case, the steam produced as described above is injected into the formation via at least one injection well. The steam mobilizes hydrocarbons contained in the formation, such as heavy oil or hydrocarbons contained in oil sands, which are recovered in at least a collection well (which can be the same as the injection well or which can be a different well). Produced water is also recovered in the collection well. Usually, produced hydrocarbons and water are mainly in the form of a water/oil emulsion. The emulsion is separated into a hydrocarbon fraction and a water fraction according to methods known in the art.

The hydrocarbon fraction is sent to further treatment, while the water fraction may be reused as part of the source of water 1. However, according to a preferred embodiment of the present invention, the water fraction is not reused as part of the source of water 1 but is rather rejected. Thus, there is no artificial increase in the silica content of the feedwater, which may make it possible to do without any specific silica removal step.

On the other hand, it is possible to use water from cold oil production as part or all of the source of water 1, that is water produced from a collection well and separated from the produced oil, wherein the production of oil and water is obtained without any steam injection (i.e. the oil production is not assisted by any steam-based process).

Thus, an efficient recycling of the produced water from a cold oil production site is realized, without inducing problems of increase in silica content. This is advantageous when a cold oil production site is situated next to a SAGD-operated oil production site.

EXAMPLES

The following examples illustrate the invention without limiting it.

Example 1

Produced water is treated according to the claimed invention. The mineral composition of the water is the following:

| | |
|---|---|
| Sodium: | 2200 mg/L |
| Potassium: | 62 mg/L |
| Calcium: | 3 mg/L |
| Magnesium: | 6 mg/L |
| Carbonates: | 108 mg/L |
| Bicarbonate: | 2677 mg/L |
| Sulfate: | 56 mg/L |
| Chloride: | 1697 mg/L |
| Lithium: | 0 |
| Strontium: | 1 mg/L |
| Barium: | 0.2 mg/L |
| Iron: | 1.2 mg/L |
| Borous: | 0 |
| Silica: | 0 |
| Formiates: | 0 |
| Acetate: | 0 |
| pH: | 8.8 |
| Salinity from $Cl^-$ | 5 g/L |
| Specific gravity at 20° C. | 1.001 |

Calcium chloride is added to the water as the crystallizing reagent, at a concentration of 5.2×10−3 mol/L. The crystallization process generates a suspension of crystals in the produced water. Duration does not have to be so long as to promote the growth of large crystals of calcium carbonate and calcium sulfate.

The produced water with the precipitated crystals is directed to the ceramic membrane. The ceramic membrane produces a reject stream having the insoluble carbonate and sulfate salts therein. Permeate produced by the ceramic membrane may be directed downstream for further purification or to a steam generation process.

The concentration of carbonate/bicarbonate and sulfate ions in the permeate produced by the ceramic membrane is less than 200 and 10 mg/L respectively.

Example 2

Produced water is treated according to the claimed invention. The mineral composition of the water is the following:

| | |
|---|---|
| Sodium: | 2200 mg/L |
| Potassium: | 62 mg/L |
| Calcium: | 3 mg/L |
| Magnesium: | 6 mg/L |
| Carbonates: | 0 mg/L |
| Bicarbonate: | 2785 mg/L |
| Sulfate: | 800 mg/L |
| Chloride: | 1697 mg/L |
| Lithium: | 0 |
| Strontium: | 0 mg/L |
| Barium: | 0.2mg/L |
| Iron: | 1.2mg/L |
| Borous: | 0 |
| Silica: | 0 |
| Formiates: | 0 |
| Acetate: | 0 |
| pH: | 7.9 |
| Salinity from $Cl^-$ | — |
| Specific gravity at 20° C. | 1 |

Calcium chloride is added to the water as the crystallizing reagent, at a concentration of $1.3\times10^{-2}$ mol/L. The crystallization process generates a suspension of crystals in the produced water. Duration does not have to be so long as to promote the growth of large crystals of calcium carbonate and calcium sulfate.

The produced water with the precipitated crystals is directed to the ceramic membrane. The ceramic membrane produces a reject stream having the insoluble carbonate and sulfate salts therein. Permeate produced by the ceramic membrane may be directed downstream for further purification or to a steam generation process.

The concentration of carbonate/bicarbonate and sulfate ions in the permeate produced by the ceramic membrane is less than 200 and 10 mg/L respectively.

The invention claimed is:

1. A method for producing steam comprising the successive steps of:

a) providing feedwater containing carbonate and/or sulfate ions;

b) adding a crystallizing reagent able to react with carbonate and/or sulfate ions to the feedwater, in order to produce carbonate and/or sulfate crystals;

c) filtering the feedwater obtained at step b) with a ceramic membrane to produce a permeate stream;

d) supplying the permeate stream to a boiler; and e) generating steam in the boiler.

2. The method of claim 1, comprising, prior to step d) of supplying the permeate stream obtained at step c) to the boiler, the additional step of:

treating the permeate stream in an ion exchange unit; and/or treating the permeate stream in a reverse osmosis unit; and/or treating the permeate stream in an evaporation unit.

3. The method of claim 1, wherein the crystallizing reagent is a salt selected from the group consisting of chloride, bromide, fluoride and nitrate salts of calcium, barium, strontium, manganese or magnesium, or mixtures thereof.

4. The method of claim 1, wherein the feedwater contains between 50 and 10000 mg/L carbonate ions; and/or wherein the feedwater contains between 10 and 2000 mg/L sulfate ions.

5. The method of claim 1, wherein the crystallizing reagent is a salt having an anion and a cation, and is dosed to a molar ratio of crystallizing reagent cation-to-carbonate and sulfate ions in the feedwater of between 0.5:1 and 3:1.

6. The method of claim 1, which does not comprise any pH adjustment step prior to the step of filtering the feedwater.

7. The method of claim 1, which does not comprise any step of substantially removing silica from the feedwater or from the permeate stream.

8. The method of claim 1, which further comprises a step of substantially removing silica from the permeate stream obtained at step c) by:

treating the permeate stream from the ceramic membrane in a warm lime softening unit; or adding an additional crystallizing reagent able to react with silica to the permeate stream from the ceramic membrane and optionally adjusting the pH of said permeate stream, in order to convert soluble silica to insoluble silica, and then filtering the permeate stream in an additional ceramic membrane to produce the permeate stream to be supplied to the boiler.

9. The method of claim 1, wherein the provided feedwater is produced water from an oil production process, wherein the oil production process does not involve any steam injection.

10. The method of claim 1, which does not comprise any induced gas flotation step prior to adding the crystallizing reagent to the feedwater.

11. The method of claim 1, wherein the boiler generates a liquid blowdown and wherein the liquid blowdown is either evacuated in the environment or at least partly recycled to the feedwater.

12. An installation for producing steam comprising:

a ceramic membrane (4);

a boiler (8);

a steam conduit (9) connected to an outlet of the boiler (8);

a feedwater supply system (13) connected to an inlet of the ceramic membrane (4);

means for supplying a crystallizing reagent able to react with carbonate and/or sulfate ions to produce carbonate and/or sulfate crystals (5), an outlet of which is connected to the feedwater supply system (13); and a permeate stream conduit connected (14) to an outlet of the ceramic membrane (4) and connected to an inlet of the boiler (8).

13. The installation of claim 12, comprising a further treatment unit (6) on the permeate stream conduit (14).

14. The installation of claim 12, wherein the further treatment unit (6) comprises:

an ion exchange unit; and/or a reverse osmosis unit; and/or an evaporation unit.

15. The installation of claim 13, wherein the further treatment unit (6) comprises a silica removal unit, such as:

a warm lime softening unit; and/or an additional ceramic membrane, means for supplying an additional crystallizing reagent able to react with silica to convert soluble silica to insoluble silica, and optionally means of pH adjustment, upstream of the additional ceramic membrane.

16. The installation of claim 12, which does not comprise any silica removal unit.

17. The installation of claim 12, wherein the feedwater supply system (13) is connected to an outlet of a water recovery system from an oil production installation, wherein said oil production installation does not comprise any steam generation unit.

18. The installation of claim 12, which does not comprise any induced gas flotation unit (3).

19. The installation of claim 12, comprising a liquid blowdown conduit (10) connected to an outlet of the boiler (8), an outlet of said liquid blowdown conduit (10) being optionally connected to the feedwater supply system (13).

20. The installation of claim 12, wherein the steam conduit (9) is connected to an inlet of an injection well.

21. A process for extracting hydrocarbons from a subterranean formation comprising:

producing steam by:

a) providing feedwater containing carbonate and/or sulfate ions;

b) adding a crystallizing reagent able to react with carbonate and/or sulfate ions to the feedwater, in order to produce carbonate and/or sulfate crystals;

c) filtering the feedwater obtained at step b) with a ceramic membrane to produce a permeate stream;

d) supplying the permeate stream to a boiler; and e) generating steam in the boiler;

injecting the produced steam into at least one injection well; and recovering hydrocarbons and produced water from at least one collection well.

* * * * *